US006971460B2

(12) United States Patent
Khomynets

(10) Patent No.: US 6,971,460 B2
(45) Date of Patent: Dec. 6, 2005

(54) DOWNHOLE JET UNIT FOR TESTING AND COMPLETING WELLS

(76) Inventor: Zinoviy Dmitrievich Khomynets, d.33, ul. Vilshanetskaya, Tismenitsa, obl.Ivano-Frankovskaya (UA) 77400

( * ) Notice: Subject to any disclaimer, the term of this patent is extended or adjusted under 35 U.S.C. 154(b) by 28 days.

(21) Appl. No.: 10/467,598

(22) PCT Filed: Nov. 9, 2001

(86) PCT No.: PCT/RU01/00473

§ 371 (c)(1),
(2), (4) Date: Aug. 6, 2003

(87) PCT Pub. No.: WO02/066839

PCT Pub. Date: Aug. 29, 2002

(65) Prior Publication Data

US 2004/0067142 A1 Apr. 8, 2004

(30) Foreign Application Priority Data

Feb. 20, 2001 (RU) ..... 2001104496

(51) Int. Cl.[7] ..... E21B 10/60

(52) U.S. Cl. ..... 175/424; 175/67

(58) Field of Search ..... 175/67, 40, 424; 166/222, 242.6; 299/17.5; 417/172, 176

(56) References Cited

U.S. PATENT DOCUMENTS

| | | | | |
|---|---|---|---|---|
| 4,293,283 | A | 10/1981 | Roeder | 417/172 |
| 4,744,730 | A | 5/1988 | Roeder | 417/172 |
| 6,460,936 | B1 * | 10/2002 | Abramov et al. | 299/17 |

FOREIGN PATENT DOCUMENTS

| | | |
|---|---|---|
| RU | 2059891 | 10/1996 |
| RU | 2121610 | 10/1998 |
| SU | 1668646 | 7/1991 |

* cited by examiner

*Primary Examiner*—Frank S. Tsay
(74) *Attorney, Agent, or Firm*—Dellett & Walters

(57) ABSTRACT

The invention relates to pumping engineering, mainly to downhole jet production units. The inventive downhole jet unit comprises a packer, a pipe column and a jet pump. An active nozzle is embodied in the body of the jet pump, and a pass channel provided with a mounting face for a sealing assembly with an axial channel is embodied therein. Said unit is also provided with an irradiator and a receiver transformer of physical fields which are mounted on a cable. The output of the jet pump is connected to a space around the pipe column. The input of a channel for feeding the pumped out medium of the jet pump is connected to the internal space of the pipe column below the sealing assembly. The input of a channel supplying a working medium to the active nozzle is connected to the internal space of the pipe column above the sealing assembly. The invention makes it possible to optimise dimensions of various elements of the unit, thereby increasing the operating reliability of the downhole jet unit.

1 Claim, 2 Drawing Sheets

DOWNHOLE JET UNIT FOR TESTING AND COMPLETING WELLS

FIELD OF INVENTION

This invention relates to the field of pumping engineering, mainly to downhole jet units for production of oil and intensification of oil inflow from wells.

PRIOR ART

Known in the art is a downhole jet unit comprising a jet pump installed on the production string in the well and a geophysical instrument placed in the production string below the said jet pump (SU 1668646 A1).

The said jet pumping unit enables to pump different extracted media, e.g., oil, out of the well with the simultaneous treatment of the extracted medium and the well formation zone, but the arrangement of the jet pump above the sealing assembly sometimes does not enable to make the channels for supplying the pumped out medium in an optimal relation to the diameter of the channels for supplying the working medium, thus, in some cases, narrowing the field of application of the said unit.

The closest, as to its technical essence and the achievable result, to this invention is a downhole jet unit for testing and completing wells, which comprises a packer, a piping string and a jet pump, the body of the said pump comprising an active nozzle and a mixing chamber, as axially arranged therein, and a pass channel made with a mounting face for installing a sealing assembly with an axial channel, the said downhole jet unit being provided with an irradiator and receiver-transformer of physical fields, which is arranged on the jet pump side for entry of the medium pumped out of the well and is installed on the cable put through the axial channel of the sealing assembly, the output side of the jet pump is connected to the space surrounding the piping string, the jet pump channel side for entry of the pumped out medium is connected to the inner cavity of the piping string below the sealing assembly, and the input side of the channel for supplying the working medium to the active nozzle is connected to the inner cavity of the piping string above the sealing assembly (RU 2059891 C1).

The said downhole jet unit enables to perform various production operations in the well below the jet pump installation level by, inter alia, reducing a pressure difference both above and below the sealing assembly. However, the said downhole jet unit does not enable to utilize its possibilities in full due to non-optimal relationships between dimensions of various components of the construction of the downhole jet unit.

DISCLOSURE OF INVENTION

The objective of this invention is to optimize the dimensions of various components of the construction of the downhole jet unit and, owing to it, to raise the reliability of its operation.

The stated objective is achieved owing to the fact that the downhole jet unit comprises a packer, a piping string and a jet pump, in the body of which an active nozzle and a mixing chamber are axially arranged, and a pass channel is made with a mounting face for installing a sealing assembly having an axial channel, the said unit being provided with an irradiator and receiver-transformer of physical fields, which is arranged at the jet pump side for entry of the medium pumped out of the well and is mounted on the cable put through the axial channel of the sealing assembly, the jet pump output side is connected to the hole clearance, the input side of the channel for supplying the pumped out medium of the jet pump is connected to the inner cavity of the piping string below the sealing assembly, and the input side of the channel for supplying the working medium to the active nozzle is connected to the inner cavity of the piping string above the sealing assembly, wherein, according to this invention, the diameter of the channel for supplying the working medium is not less than the diameter of the mixing chamber, the diameter of the pass channel below the mounting face is, at least, 0.8 mm less than its diameter above the mounting face, the diameter of the sealing assembly is, at least, 1.6 mm less that the diameter of the inner hole of the tubes, the diameter of the axial channel in the sealing assembly is, at least, 0.009 mm larger than the diameter of the cable, the diameter of the irradiator and receiver-transformer of physical fields is, at least, 1.6 mm less that the diameter of the pass channel below the mounting face, the diameter of the pass channel in the packer is, at least, 1.6 mm larger than the diameter of the irradiator and receiver-transformer of physical fields, and the irradiator and receiver-transformer of physical fields is made with the possibility of its operation in the under-packer zone both when the jet pump is working and when it is stopped.

The analysis of the operation of the downhole jet unit has shown that the its reliability may be increased by making various components of the construction of the unit according to strictly defined dimensions. Taking into account that the jet pump capacity mainly depends on the flow rate of the working medium passing through the active nozzle, the diameter of the channel for supplying the working medium to the active nozzle has been selected as the typical dimension. It has been found out in this connection that it is not advisable to make the diameter of the said channel less that the diameter of the mixing chamber. As to the upper limit, it should be defined by the strength characteristics of the jet pump construction, and, first of all, by those of the jet pump body, as well as by the required maximum capacity, which is necessary for pumping the medium out of the well. In each particular case this value is to be determined individually. In the course of the unit operation studies of different well modes are conducted. One has to install and remove the sealing assembly, and move, in the process of operation, the irradiator and receiver-transformer of physical fields along the well. It has been determined that it is not advisable to make the diameter of the pass channel below the mounting face of the sealing assembly that it would be less than 0.8 mm less than the diameter of the inner hole of the piping string, and the diameter of the sealing assembly itself should be made at least 1.6 mm less than the diameter of inner hole of the piping string. In the result, possible sticking of the sealing assembly in the piping string during installation or removal of the sealing assembly is precluded, and the reliable installation of the sealing assembly onto the mounting face is ensured. It has already been said that in the process of the unit operation it is necessary to move the irradiator and receiver-transformer of physical fields along the well and, at the same time, minimize the medium flow through the axial channel of the sealing assembly. It has been achieved by making the irradiator and receiver-transformer of physical fields at least 1.6 mm less than the diameter of the packer pass channel and the diameter of the pass channel below the sealing assembly mounting face, and the diameter of the axial channel in the sealing assembly should be made that it would be at least 0.009 mm larger than the diameter of the cable, on which the irradiator and receiver-transformer of physical fields is installed. Finally, the above-indicated relationships of dimensions enable to arrange the irradiator and receiver-transformer of physical fields in the under-packer zone both when the jet pump is working and when the jet pump is stopped. It enables to expand the range of studies carried out in wells, which is of special importance when carrying restoration works.

Thus, the objective of the invention—to optimize the dimensions of various components of the construction of the unit and, owing to it, raise the reliability of operation of the downhole jet unit—has been achieved.

BEST EMBODIMENT OF THE INVENTION

Figure 1:
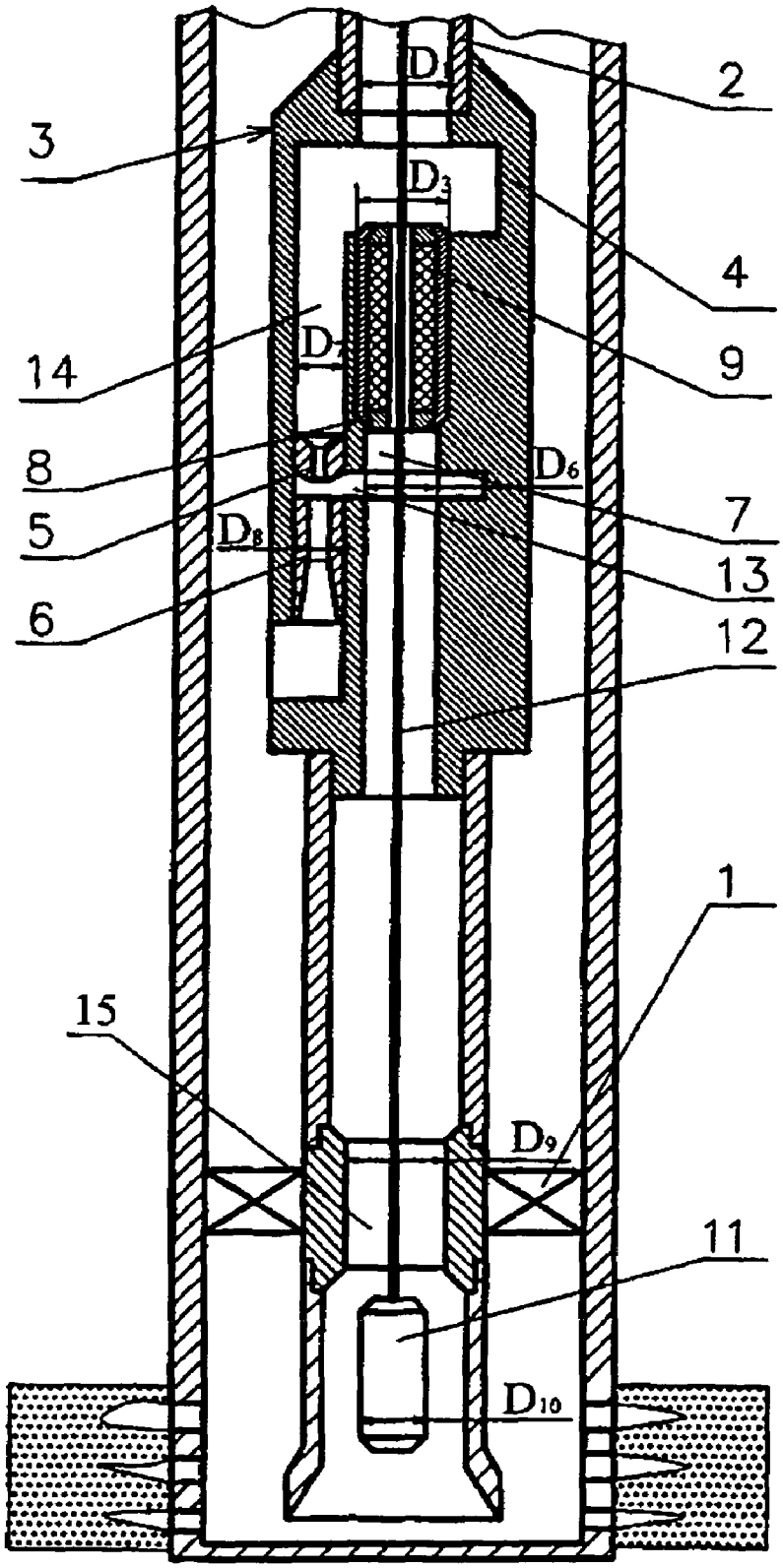
FIG. 1 represents a longitudinal section of the disclosed downhole jet unit.
Figure 2:
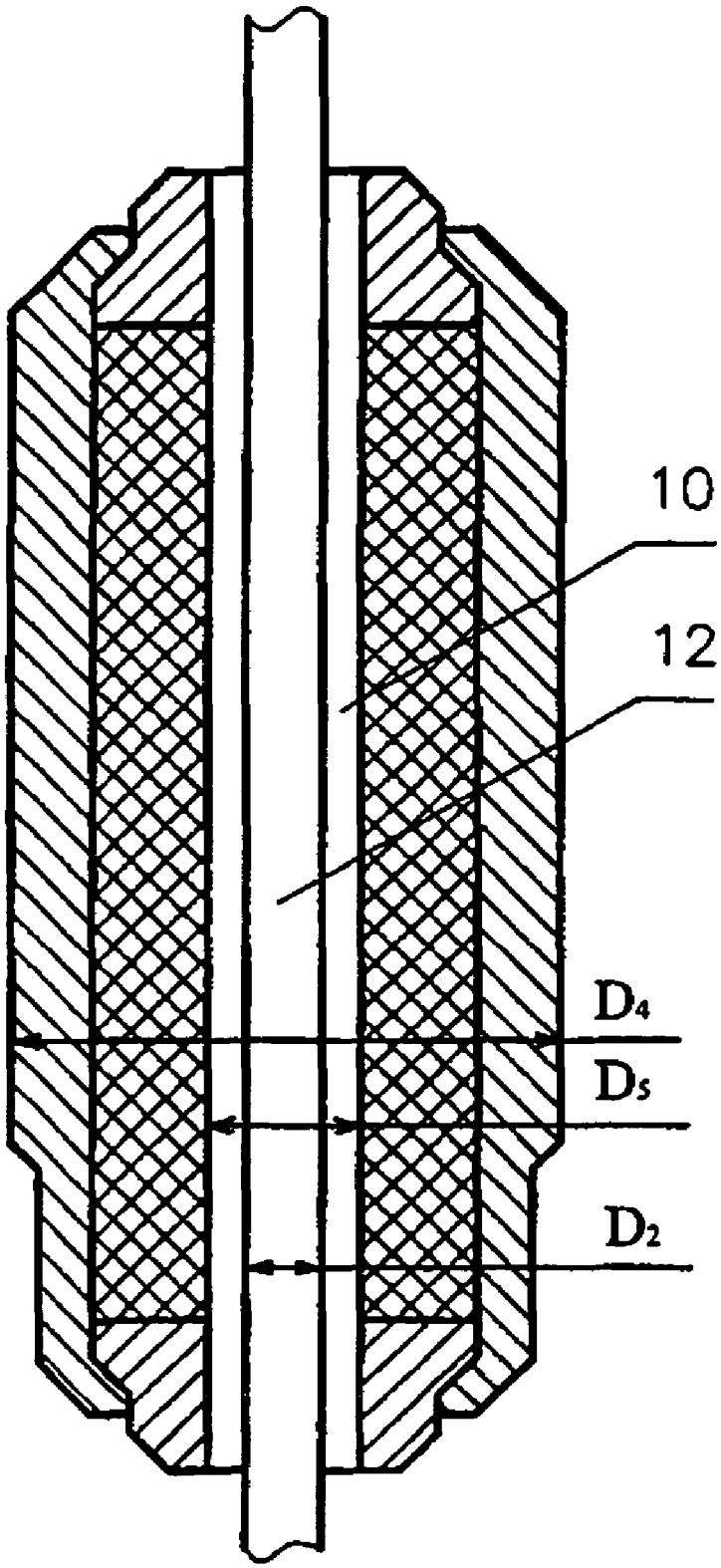
FIG. 2 represents a longitudinal section of the sealing assembly.

The downhole jet unit for testing and completing wells comprises a packer 1, a piping string 2, and a jet pump 3, in the body 4 of which an active nozzle 5 and a mixing chamber 6 are axially arranged, and a pass channel 7 is made with a mounting face 8 for installing a sealing assembly 9 having an axial channel 10. The unit is also provided with an irradiator and receiver-transformer 11 of physical fields, which is arranged at the side of the jet pump 3 for entry of the medium pumped out of the well and is mounted on the cable 12 put through the axial channel 10 of the sealing assembly 9. The output side of the jet pump 3 is connected to the space surrounding the piping string 2. The input side of the channel 13 for supplying the pumped out medium of the jet pump 3 is connected to the inner cavity of the piping string 2 below the sealing assembly 9, and the input side of the channel 14 for supplying the working medium to the active nozzle 5 is connected to the inner cavity of the piping string 2 above the sealing assembly 9. The diameter $D_7$ of the channel 14 for supplying the working medium is not less than the diameter $D_8$ of the mixing chamber. The diameter $D_6$ of the pass channel 7 below the mounting face 8 is, at least, 0.8 mm less than its diameter $D_3$ above the mounting face 8. The diameter $D_4$ of the sealing assembly 9 is, at least, 1.6 mm less that the diameter $D_1$ of the inner hole of the tubes 2. The diameter $D_5$ of the axial channel 10 in the sealing assembly 9 is, at least, 0.009 mm larger than the diameter $D_2$ of the cable 12. The diameter $D_{10}$ of the irradiator and receiver-transformer 11 of physical fields is, at least, 1.6 mm less that the diameter $D_6$ of the pass channel 7 below the mounting face 8. The diameter $D_9$ of the pass channel 15 in the packer 1 is, at least, 1.6 mm larger than the diameter $D_{10}$ of the irradiator and receiver-transformer of physical fields, and the irradiator and receiver-transformer 11 of physical fields is made with the possibility of operating in the under-packer zone both when the jet pump 3 is operating and when it is stopped.

The jet pump 3 and the packer 1 on the piping string 2 are lowered into the well and are placed above the producing formation. The packer 1 is brought into the operating position, thus separating the space surrounding the piping string in the well. The sealing assembly 9 and the irradiator and receiver-transformer 11 of physical fields are lowered on the cable 12. Via the piping string 2 a working medium, e.g., water, salt solution, oil, etc., is pumped. The working medium comes from the piping string through the channel 14 into the active nozzle 5 of the jet pump 3. Within a few seconds after the pumping of the working medium through the active nozzle 5 a stable jet is formed at the nozzle output, which, going out of the nozzle 5, entrains the surrounding medium into the jet pump, which results in a pressure reduction first in the channels 13 for supplying the pumped out medium and then in the under-packer space of the well, thus creating pressure drawdown onto the producing formation. The amount, for which the pressure is lowered, depends on the rate, at which the working medium goes through the active nozzle 5, which rate, in its turn, depends on the pressure value of the working medium discharged into the piping string 2 above the sealing assembly 9. In the result, the formation medium comes over the section of the piping string 2 below the sealing assembly 9 and goes through the channels 13 into the jet pump 3, where it is mixed with the working medium, and the mixture of the media, owing to the energy of the working medium comes over the borehole clearance of the piping string 2 out of the well and on the surface. During the pumping out of the formation medium the parameters of the pumped out formation medium are monitored, and the formation medium is influenced with the irradiator and receiver-transformer 11 of physical fields. Depending on a particular task it is possible to move the irradiator and receiver-transformer 11 of physical fields along the well, including the arrangement of the irradiator and receiver-transformer 11 of physical fields in the under-packer zone at the level of the producing formation.

INDUSTRIAL APPLICABILITY

This invention may be applied when testing, completing and operating oil or gas condensate wells as well as when conducting workover jobs thereon.

What is claimed is:

1. A downhole jet unit for testing and completing wells, comprising a packer, a piping string and a jet pump, in the body of which an active nozzle and a mixing chamber are axially arranged, and a pass channel is made with a mounting face for installing a sealing assembly having an axial channel, said unit being provided with an irradiator and receiver-transformer of physical fields, which is arranged at a jet pump side for entry of the medium pumped out of the well and is mounted on a cable put through the axial channel of the sealing assembly, a jet pump output side is connected to the space surrounding the piping string, an input side of the channel for supplying the pumped out medium of the jet pump is connected to the inner cavity of the piping string below the sealing assembly, and the input side of the channel for supplying the working medium to the active nozzle is connected to the inner cavity of the piping string above the sealing assembly, wherein the diameter of the channel for supplying the working medium is not less than the diameter of the mixing chamber, the diameter of the pass channel below the mounting face is, at least, 0.8 mm less than its diameter above the mounting face, the diameter of the sealing assembly is, at least, 1.6 mm less than the diameter of an inner hole of the tubes, the diameter of the axial channel in the sealing assembly is, at least, 0.009 mm larger than the diameter of the cable, the diameter of the irradiator and receiver-transformer of physical fields is, at least, 1.6 mm less than the diameter of the pass channel below the mounting face, the diameter of the pass channel in the packer is, at least, 1.6 mm larger than the diameter of the irradiator and receiver-transformer of physical fields, and the irradiator and receiver-transformer of physical fields is made with the possibility of operating in an under packer-zone both when the jet pump is operating and when it is stopped.

* * * * *